US008261498B2

(12) United States Patent
Poirier

(10) Patent No.: US 8,261,498 B2
(45) Date of Patent: Sep. 11, 2012

(54) MODIFIED GLAZING ASSEMBLY FOR ROUGH OPENINGS

(75) Inventor: Peter P. Poirier, Ashland, OH (US)

(73) Assignee: Tremco Incorporated, Beachwood, OH (US)

( * ) Notice: Subject to any disclaimer, the term of this patent is extended or adjusted under 35 U.S.C. 154(b) by 498 days.

(21) Appl. No.: 12/142,371

(22) Filed: Jun. 19, 2008

(65) Prior Publication Data

US 2009/0313921 A1 Dec. 24, 2009

(51) Int. Cl.
*E06B 3/30* (2006.01)

(52) U.S. Cl. ..... 52/204.53; 52/58; 52/60; 52/211

(58) Field of Classification Search ..... 52/58, 60, 52/61, 62, 204.53, 204.54, 200, 201, 211, 52/212, 204.55

See application file for complete search history.

(56) References Cited

U.S. PATENT DOCUMENTS

| | | | | | |
|---|---|---|---|---|---|
| 1,853,467 | A | * | 4/1932 | Simpson et al. | 49/475.1 |
| 2,778,793 | A | * | 1/1957 | Frederick et al. | 204/165 |
| 3,024,503 | A | | 3/1962 | Zoellner | |
| 3,103,710 | A | * | 9/1963 | Fredricksen | 52/211 |
| 3,209,669 | A | * | 10/1965 | Bayne | 454/368 |
| 3,359,688 | A | * | 12/1967 | Kondolf | 49/490.1 |
| 3,421,276 | A | * | 1/1969 | La Barge | 52/287.1 |
| 3,623,288 | A | * | 11/1971 | Horowitz | 52/264 |
| 3,696,575 | A | * | 10/1972 | Armstrong | 52/288.1 |
| 3,760,544 | A | * | 9/1973 | Hawes et al. | 52/468 |
| 3,838,544 | A | * | 10/1974 | Hindall | 52/60 |
| 4,164,105 | A | * | 8/1979 | Herbst et al. | 52/202 |
| 4,184,297 | A | * | 1/1980 | Casamayor | 52/202 |
| 4,385,850 | A | * | 5/1983 | Bobath | 403/205 |
| 4,539,243 | A | * | 9/1985 | Miller | 428/99 |
| 4,689,930 | A | * | 9/1987 | Menchetti | 52/277 |
| 4,700,512 | A | * | 10/1987 | Laska | 52/58 |
| 4,821,472 | A | * | 4/1989 | Tix | 52/204.55 |
| 4,999,957 | A | * | 3/1991 | Kessler | 52/213 |
| 5,018,333 | A | * | 5/1991 | Bruhm | 52/741.4 |
| 5,077,943 | A | * | 1/1992 | McGady | 52/58 |
| 5,119,609 | A | | 6/1992 | Tait et al. | |
| 5,154,025 | A | * | 10/1992 | Brown | 52/58 |

(Continued)

FOREIGN PATENT DOCUMENTS

CH 672162 A * 10/1989

(Continued)

OTHER PUBLICATIONS

International Search Report from PCT/US07/079358, mailed Jan. 23, 2008.

(Continued)

*Primary Examiner* — Robert J. Canfield
*Assistant Examiner* — Charissa Ahmad
(74) *Attorney, Agent, or Firm* — Calfee, Halter & Griswold, LLP

(57) ABSTRACT

A modified flexible sealing membrane is provided for sealing the gap between the frame of an industrial window and the rough opening in which the window is received ("building gap"). The membrane is formed from a flexible sheet defining an integral projection for receipt in an adaptor connected to the window frame. On one side of this projection, the flexible sheet defines an outer membrane portion which is wide enough to seal the building gap. On the other side of this projection, the flexible sheet defines an inner membrane portion which is wide enough to seal the gap that is often found between the different structural members which combine to form the window frame ("frame gap").

9 Claims, 11 Drawing Sheets

U.S. PATENT DOCUMENTS

| | | | | | |
|---|---|---|---|---|---|
| 5,315,797 | A | * | 5/1994 | Glover et al. | 52/171.3 |
| 5,396,746 | A | | 3/1995 | Whitmer | |
| 5,590,496 | A | * | 1/1997 | Martin et al. | 52/213 |
| 5,706,610 | A | | 1/1998 | Mayle | |
| 5,722,207 | A | * | 3/1998 | Anderson et al. | 52/204.55 |
| 5,937,597 | A | * | 8/1999 | Sono et al. | 52/204.1 |
| 6,044,611 | A | * | 4/2000 | Brunett | 52/656.5 |
| 6,052,956 | A | * | 4/2000 | Hoy et al. | 52/200 |
| 6,085,481 | A | * | 7/2000 | Lee | 52/656.8 |
| 6,148,584 | A | * | 11/2000 | Wilson | 52/717.01 |
| 6,244,013 | B1 | * | 6/2001 | Lee | 52/667 |
| 6,393,779 | B1 | * | 5/2002 | Boldt | 52/210 |
| 6,467,226 | B2 | * | 10/2002 | Dodson et al. | 52/220.1 |
| 6,482,500 | B1 | * | 11/2002 | Diginosa | 428/122 |
| 7,290,379 | B2 | * | 11/2007 | Allen | 52/745.19 |
| 7,392,625 | B2 | * | 7/2008 | Bruggink et al. | 52/204.55 |
| 7,654,046 | B2 | * | 2/2010 | Ellingson | 52/212 |
| 8,006,445 | B2 | * | 8/2011 | Burton et al. | 52/204.55 |
| 8,096,088 | B2 | * | 1/2012 | Poirier et al. | 52/204.5 |
| 2001/0034984 | A1 | * | 11/2001 | Murphy et al. | 52/204.5 |
| 2002/0059760 | A1 | * | 5/2002 | Heard et al. | 52/211 |
| 2005/0072076 | A1 | * | 4/2005 | Fulton et al. | 52/204.5 |
| 2005/0144856 | A1 | * | 7/2005 | Conlin | 52/58 |
| 2006/0070301 | A1 | * | 4/2006 | Fisher et al. | 49/504 |
| 2006/0260213 | A1 | * | 11/2006 | Williams | 52/60 |
| 2007/0011960 | A1 | * | 1/2007 | Richardson | 52/200 |
| 2008/0092463 | A1 | | 4/2008 | Poirier et al. | |

FOREIGN PATENT DOCUMENTS

| | | | | |
|---|---|---|---|---|
| DE | 20209785 | | | 11/2002 |
| DE | 102004019859 | | | 11/2005 |
| EP | 14870 | A1 | * | 9/1980 |
| EP | 796972 | | | 9/1997 |
| GB | 2246386 | A | * | 1/1992 |
| JP | 11256937 | A | * | 9/1999 |
| WO | 2008/048763 | | | 4/2008 |

OTHER PUBLICATIONS

Installation Instructions brochure, Proglaze ETA, Tremco Commercial Sealants & Waterproofing, Jan. 2008, 8 pgs.

Proglaze ETA Engineered Transition Assembly, Clear Proof of a Perfect Seal brochure, 2 pgs., Jan. 2008, Tremco Commercial Sealants & Waterproofing.

Amendment from U.S. Appl. No. 11/583,505, filed Nov. 4, 2009.

Information Disclosure Statement from U.S. Appl. No. 11/583,505, filed Feb. 6, 2008.

"Elastomeric." Collins English Dictionary—Complete & Unabridged 10th Edition. HarperColllins Publishers. Mar. 17, 2011. <Dictionary.com http://disctionary.reference.com/browse/elastomeric>.

Meeting memorandum describing certain meting attended by Peter Poirier (inventor); dated Jul. 1, 2005; 5 pages.

Proglaze ETA, internal slide show presentation describing certain industry practices, 95 pages, known prior art.

Office Action from Chinese Patent Application No. 200980120982.5, dated Jan. 21, 2012.

* cited by examiner

MODIFIED GLAZING ASSEMBLY FOR ROUGH OPENINGS

BACKGROUND AND SUMMARY

In our earlier patent disclosure, Ser. No. 11/583,505 (06821/07539), the disclosure of which is incorporated herein by reference, we describe a barrier assembly for sealing the gap between the frame of an industrial window and the rough opening of the building in which the window is received.

As shown in FIGS. 1-3, this glazing assembly takes the form of an elongated adaptor 32 carried by the window frame and a flexible sealing membrane 34 providing an air and moisture barrier for sealing building gap 27 formed between the window frame and the building framing members. Adaptor 32 defines a channel or "race" 36 for receiving a projection defined by flexible sealing membrane 34. Meanwhile, flexible sealing membrane 34 typically takes the form of a flexible sheet 38 and a projection or "dart" 46 projecting therefrom. Flexible sheet 38 defines in its longitudinal direction inside lateral edge 40 associated with the frame of the window, outside lateral edge 42 associated with the building's rough opening, and major face 44 between inside lateral edge 40 and outside lateral edge 42. In the particular embodiment shown, dart 46 extends from major face 44 of flexible sheet 38 proximate its inside lateral edge 40, while flexible sheet 38 is wide enough so that, when dart 46 is received in race 36 of adaptor 32, flexible sheet 38 can extend over and be sealed to the building's exterior structural wall, preferably to the inside or outside surface of this structural wall. Other structures are possible.

In accordance with this invention, it has been found that an even better air and moisture barrier can be provided with this arrangement if the portion of flexible sheet 38 inside dart 46, i.e., the portion of flexible sheet 38 arranged towards the window frame, is made wide enough to span and seal the gap that is often found between the different structural members which combine to form the window frame by sandwiching the glass panes of the window therebetween.

Thus, this invention provides a modified barrier assembly for sealing the building gap between the frame of a window and the rough opening of a building in which the window is received, the rough opening being defined by building framing members, the window frame being formed by multiple frame members which together define at least one frame gap therebetween, the barrier assembly comprising an adaptor carried by a first window frame member, the adaptor defining a channel along at least a majority of the perimeter of the window frame, and a flexible sealing membrane providing an air and moisture barrier between the window frame and the building framing members, the flexible sealing membrane being formed from multiple membrane sections, at least one of the membrane sections being formed from a flexible sheet and a projection integral with the flexible sheet, the flexible sheet defining an inner membrane portion associated with the window frame and an outer membrane portion associated with the building framing members, the inner membrane portion and the outer membrane portion each being wide enough so that when the projection is received in the channel of the adaptor, the inner membrane portion spans the frame gap while the outer membrane portion spans the building gap, thereby providing an air and moisture-proof barrier between the window frame and the associated building framing member.

In addition, this invention further provides a modified flexible sealing membrane capable of sealing the building gap between the frame of an industrial window and the rough opening in which the window is received, the modified flexible sealing membrane also being capable of sealing the frame gap between the different structural members which combine to form the window frame by sandwiching the glass panes of the window therebetween, the modified flexible sealing membrane comprising a flexible sheet defining an integral projection for receipt in an adaptor carried by the window frame, the flexible sheet defining on one side of the projection an outer membrane portion which is wide enough to seal the building gap, the flexible sheet defining on the other side of the projection an inner membrane portion which is wide enough to seal the frame gap.

Moreover, this invention also provides a corner membrane for use in forming the modified barrier assembly of this invention, this corner membrane comprising a flexible sheet having a major face having first and second projections thereon the flexible sheet further defining first and second inner membrane portions associated with respective first and second window frame side sections as well as first and second outer membrane portions associated with respective building framing members, the inner membrane portions being wide enough so that when the first and second projections are received in the channels of respective adaptors, the inner membrane portions span the frame gaps of respective frame side sections, the outer membrane portions being wide enough so that when the first and second projections are received in the channels of respective adaptors, the outer membrane portions span the building gaps adjacent respective frame side sections.

BRIEF DESCRIPTION OF THE DRAWINGS

The present invention may be more readily understood by reference to the following drawings wherein.

DETAILED DESCRIPTION

Figure 4:
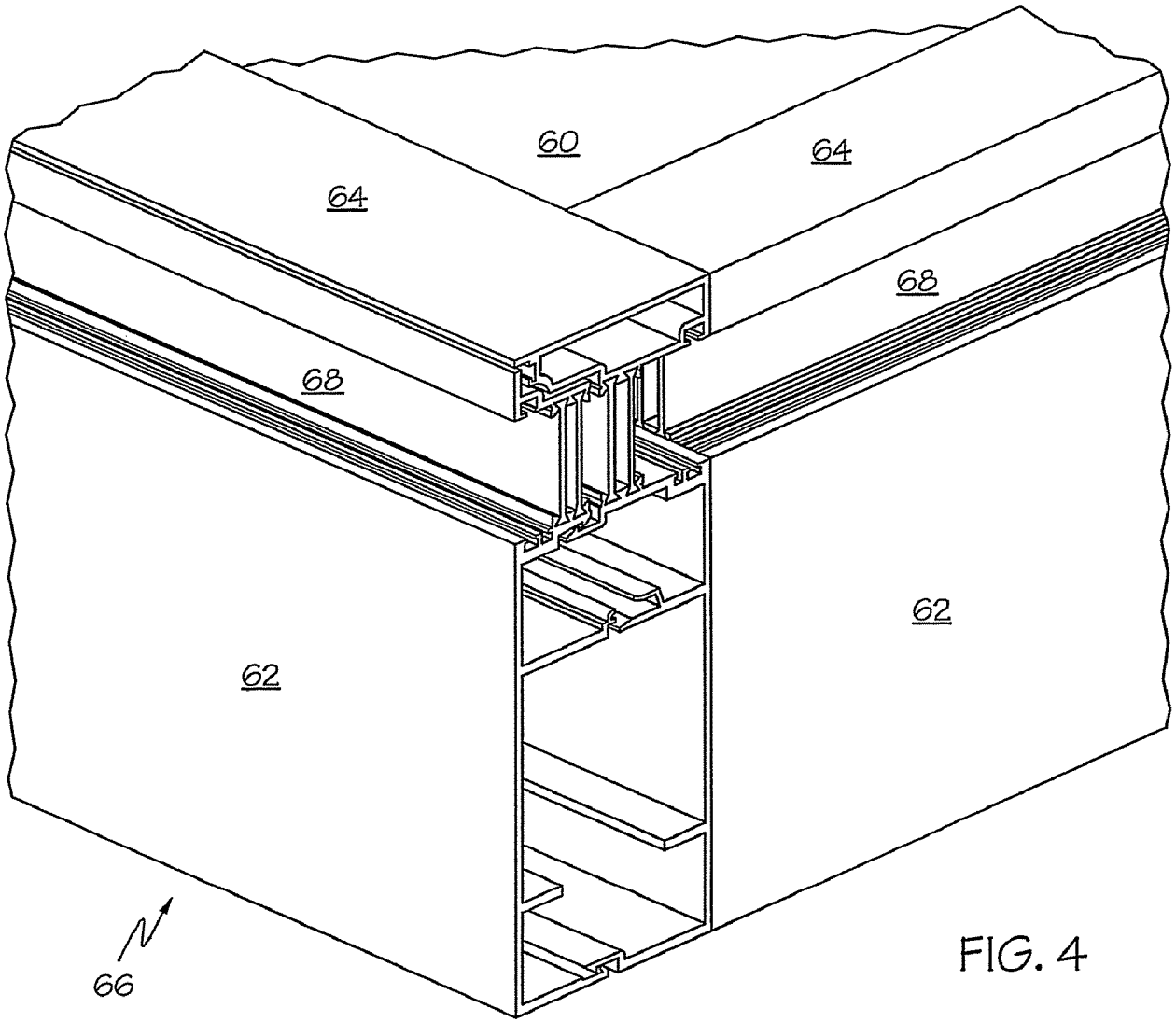
FIG. 4 is a perspective view showing the corner of an industrial window frame, FIG. 4 illustrating the gap that is formed between the inside and outside frame members which define this window frame.

As shown in FIG. 4, a conventional industrial window comprises one or more panes of glass 60 and window frame 66. Window frame 66 is composed of inside frame member 62 normally arranged towards the inside of the building and outside frame member 64 normally arranged towards the outside of the building. Inside and outside frame members 62/64 sandwich the lateral edges of glass panes 60 therebetween, with screws or other fasteners (not shown) being provided for drawing these frame members together thereby securely holding glass panes 60 in place.

Inside and outside frame members 62/64 are normally made from extruded aluminum, but can be made from any other material including other metals, wood, plastic, etc. In the particular embodiment shown, inside and outside frame members 62/64 are hollow and exhibit a particular profile. Solid window frame members can also be used in this invention, as can hollow window frame members with any other profile.

As illustrated in FIG. 4, when the industrial window is in a fully assembled condition, inside and outside frame members 62/64 define a gap 68 therebetween ("frame gap") which generally corresponds to (or at least is attributable to) the thickness of the window panes 60. Frame gap 68 represents a potential opening or pathway for penetration by air and/or water, which could lead to significant problems over time. In accordance with this invention, frame gap 68 is sealed against such air/moisture penetration by making the inside lateral edge 40 of flexible sheet 38 wide enough so that it can extend over and be sealed to outside frame member 64.

Figure 5:
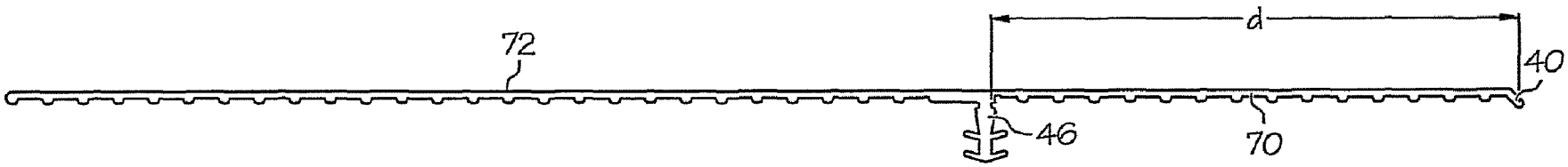
FIGS. 5 and 6 illustrate the modified flexible sealing membrane of this invention.
Figure 6:
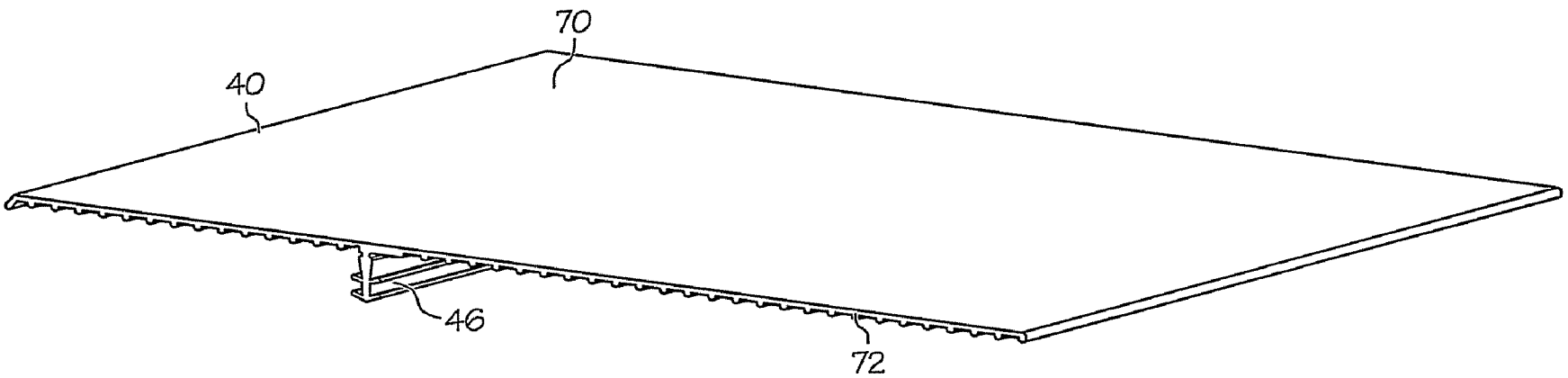

This is illustrated in FIGS. 5 and 6, which show that dart or projection 46, rather than being located immediately proximate inside lateral edge 40, is spaced away from this inside lateral edge by a distance "d." As a result, flexible sheet 38 of flexible sealing membrane 34 defines an inner membrane portion 70 on one side of dart 46 and an outer membrane portion 72 on the other side of dart 46. As in earlier embodiments of our invention, outer membrane portion 72 is wide enough so that it extends over and seals the gap between window frame 66 and the facing building structural member ("building gap"). Normally, outer membrane portion 72 is wide enough so that it can be sealed to the inside or outside surface of the building's exterior structural wall, which is usually (although not always) covered with an "air barrier" in the form of a flexible plastic sheet or sprayed-on layer of plastic.

Figure 1:
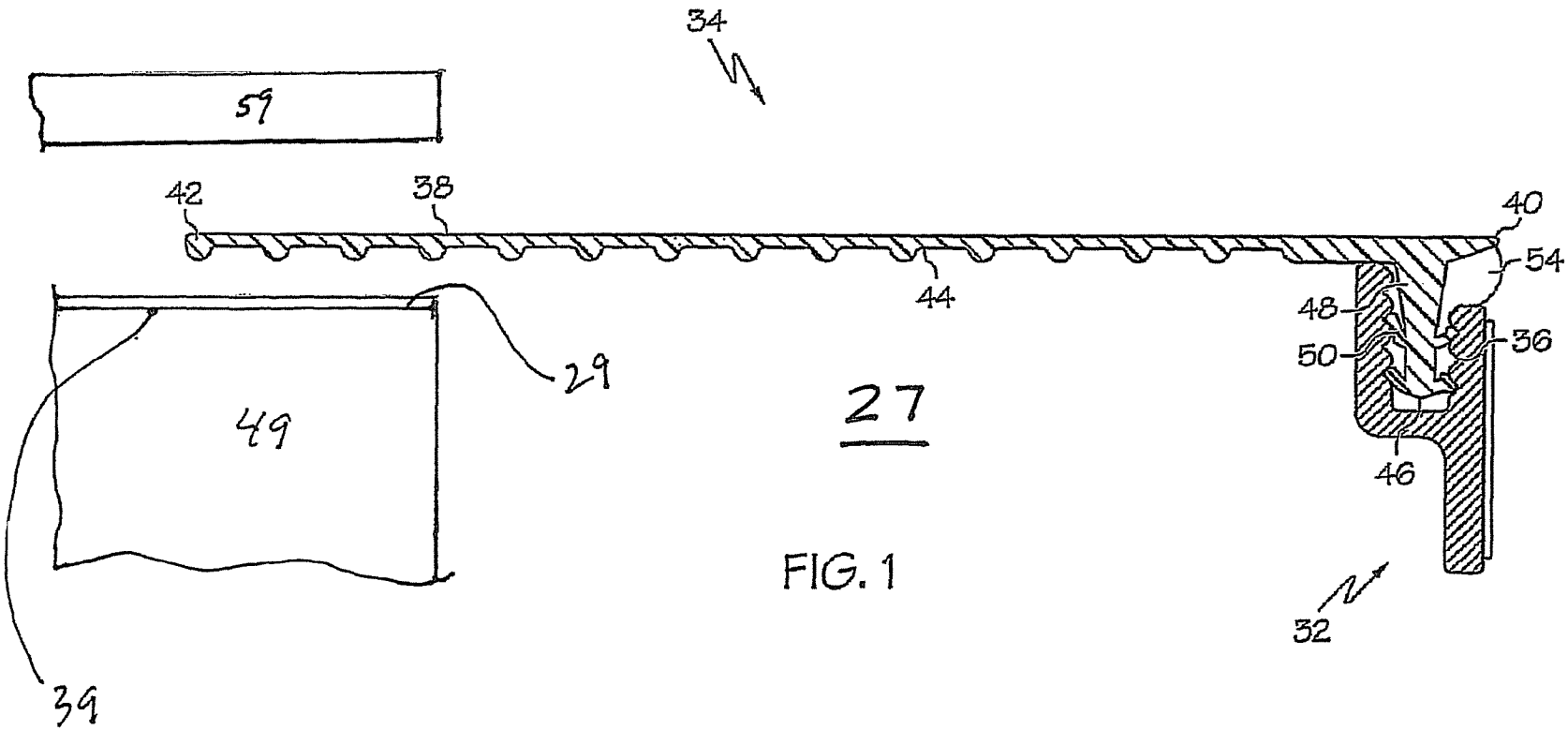
FIGS. 1-3 are cross-sectional and perspective illustrations of the inventive barrier assembly of our earlier patent disclosure Ser. No. 11/583,505 (06821/07539)
Figure 2:
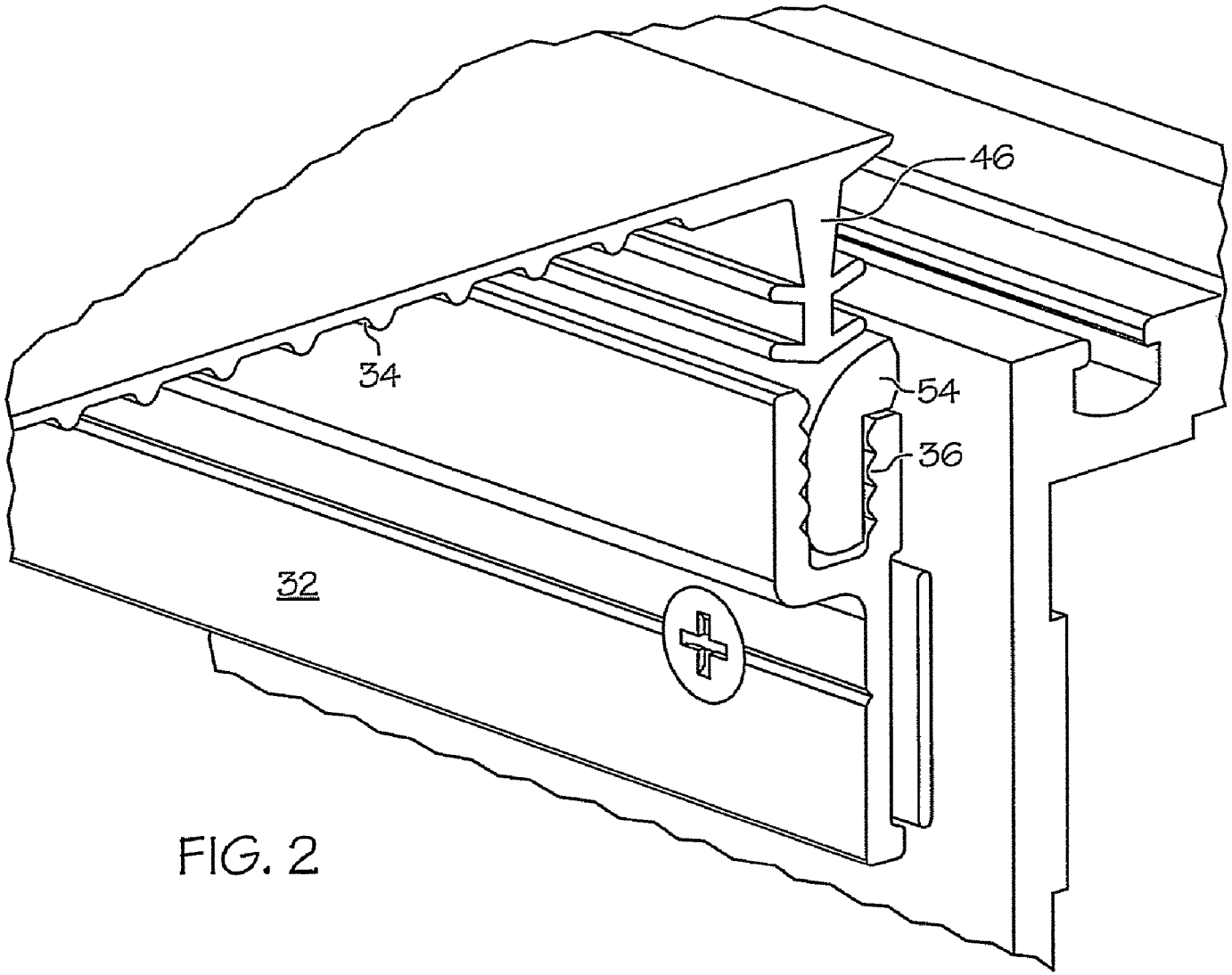
Figure 3:
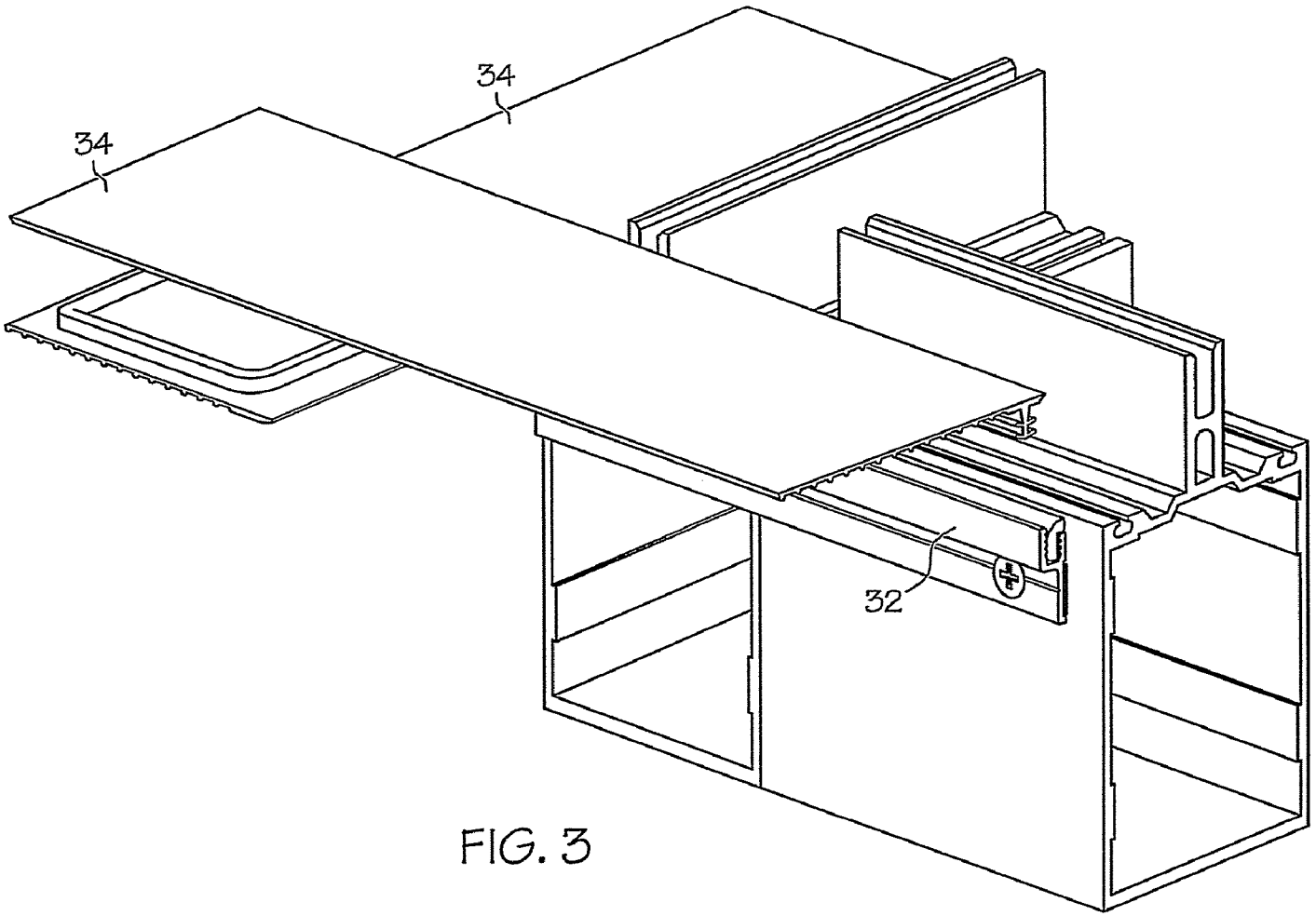
Figure 7:
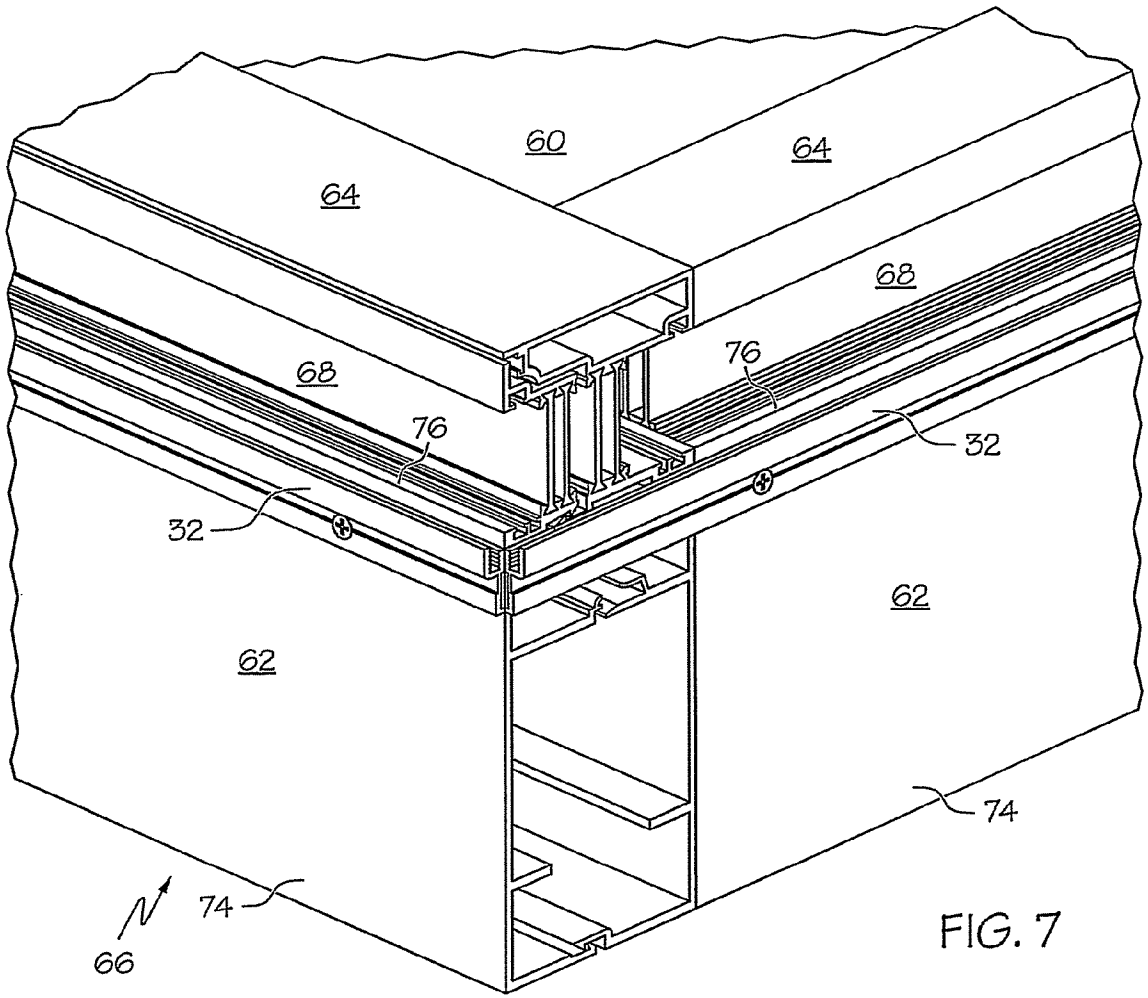
FIG. 7 is an enlarged perspective view illustrating details of how the elongated adaptor of the inventive barrier assembly can be mounted on the inside frame member of an industrial window frame side section.
Figure 8:
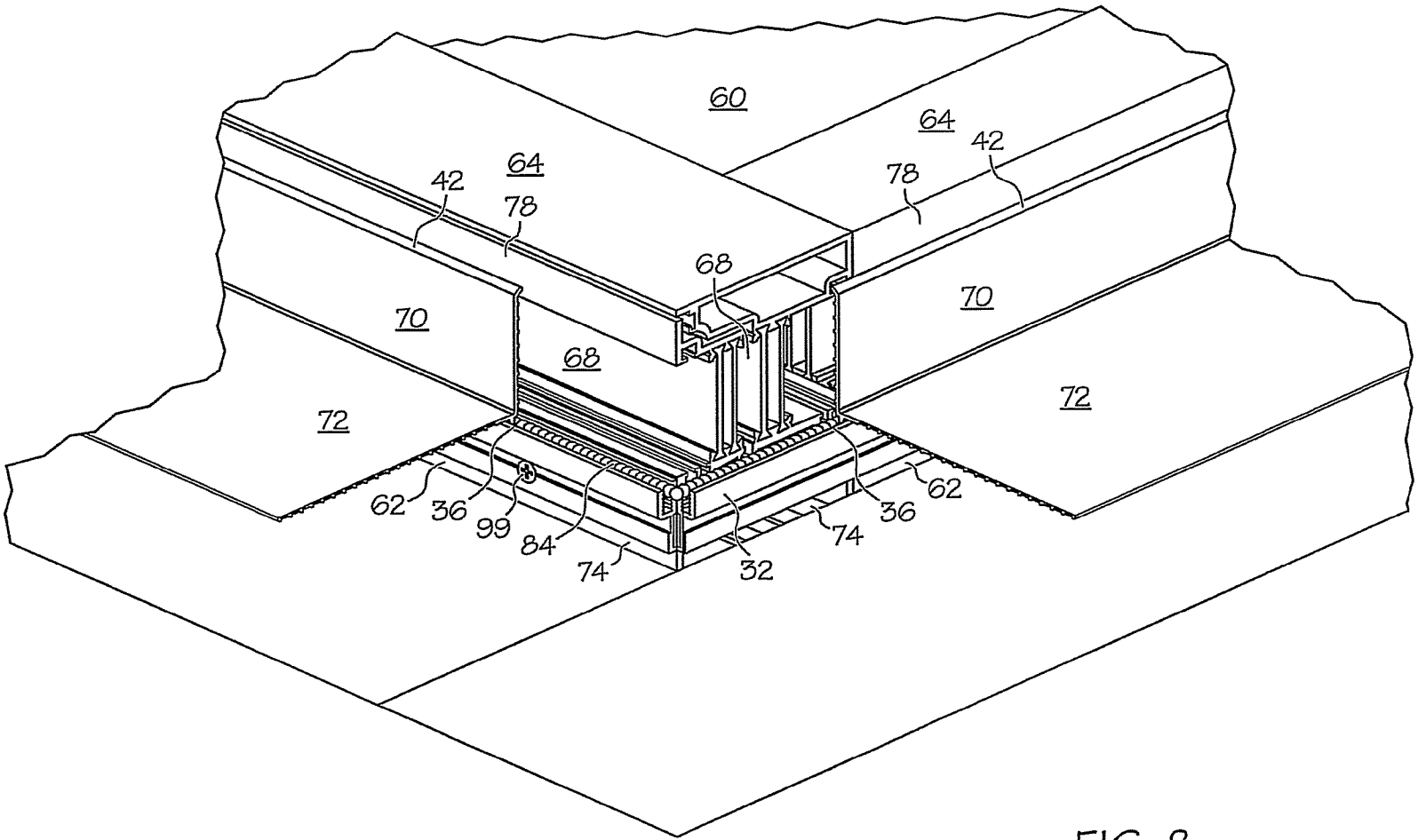
FIG. 8 is an enlarged perspective view illustrating how the modified flexible sealing membrane of this invention is attached to this elongated adaptor in such a way that it spans and seals the gap between the inside and outside frame members of the industrial window frame in accordance with this invention in addition to sealing the gap between the window frame and the rough opening of the building.

In accordance with this invention, distance "d" is large enough so that inner membrane portion 70 can seal frame gap 68 when dart 46 is received in elongated adaptor 32 mounted on inside frame member 62 of frame 66. As shown in FIG. 7, elongated adaptor 32 in the particular embodiment shown in these figures is mounted on the lateral face 74 of inside frame member 62 at or near its forwardmost edge 76. As shown in FIG. 8, when dart 46 of flexible sealing membrane 34 is received in race 36 of elongated adaptor 32, inner membrane portion 70 of flexible sealing membrane 34 is wide enough so that it completely spans frame gap 68. As a result, outside lateral edge 42 of flexible sealing membrane 34 engages (contacts) the lateral face 78 of outside frame member 64, thereby effectively sealing frame gap 68 against penetration by air and/or moisture. Thus, modified flexible sealing membrane 34 of this invention, in addition to sealing building gap 27 (FIG. 1) between window frame 66 and the building's structural wall as in our earlier invention, also seals frame gap 68 between the two frame members 62/64 that form window frame 66.

As in the case of our earlier invention, modified sealing membrane 34 of this invention can be made by molding or extruding an elastomeric material such as butyl rubber, neoprene rubber, EPDM, silicone rubber or the like. Silicone rubber is desirable in some embodiments because it is essentially transparent, i.e., its relative transparency allows moisture-proof sealant applied on its underside to be seen through its body. Similarly, modified flexible sealing membrane 34 can also be supplied in kit form for custom manufacturing the modified barrier assembly of this invention on site, as in our earlier invention. For example, modified flexible sealing membrane 34 can be provided in the form of a stock piece of indeterminate length for subdividing on site by the glazier and/or installer. Alternately, one or more modified flexible sealing membrane sections already sized into appropriate, predetermined lengths can be provided.

Figure 9:
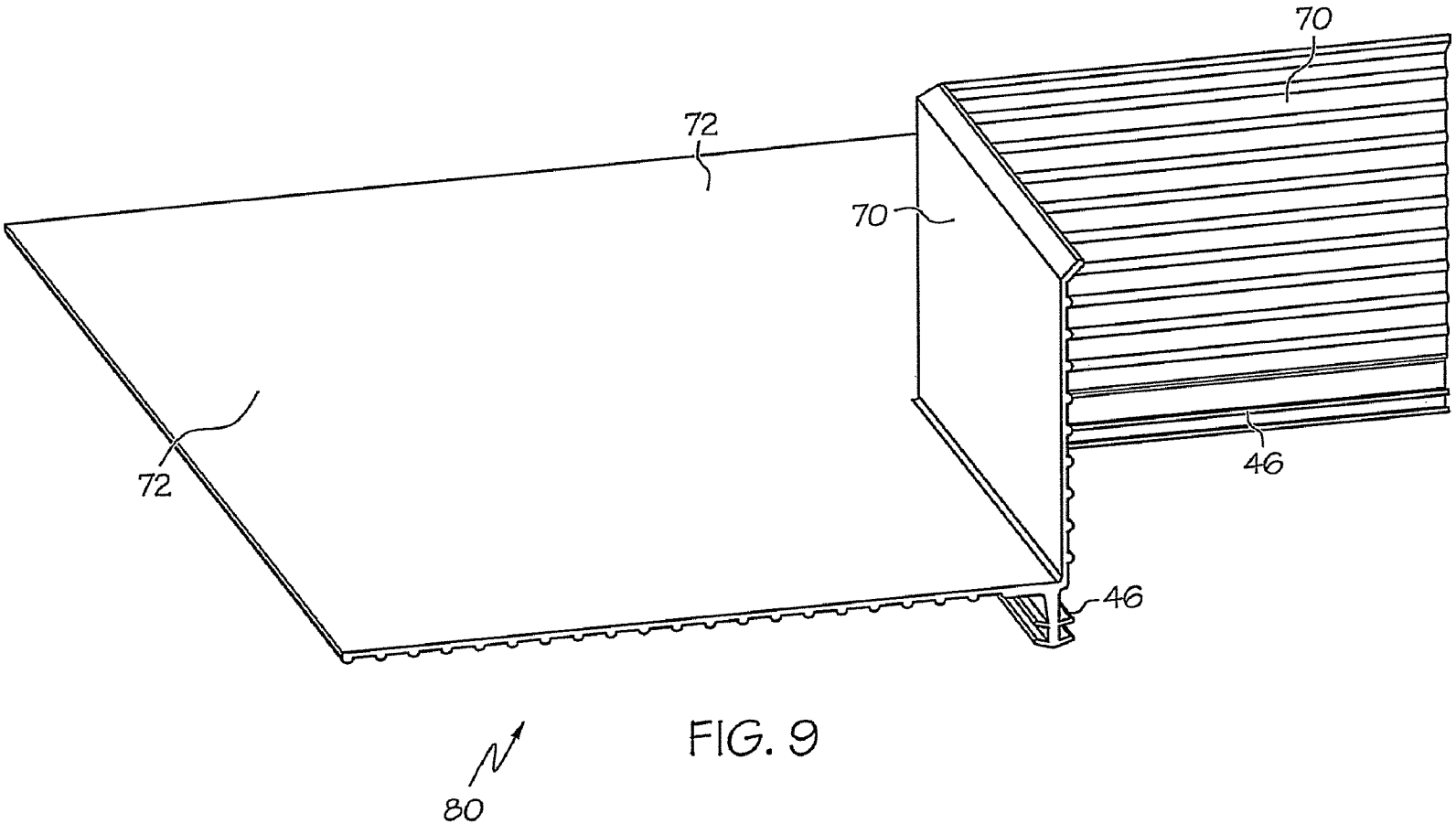
FIG. 9 is an enlarged perspective view illustrating a modified corner membrane that can be used in the modified barrier assembly of this invention.

In order to seal the corners of an industrial window using the modified barrier assembly of this invention, a modified corner sealing membrane 80, as illustrated in FIG. 9, can be used. As shown in this figure, modified corner sealing membrane 80 has essentially the same structure as corner sealing membrane 72 shown in FIG. 7 of prior patent disclosure Ser. No. 11/583,505 (06821/07539). However, in this invention, modified corner sealing membrane 80 also includes a pair of inner membrane portions 70 arranged at a generally right angle with respect to one another and, in addition, generally parallel to, and opposite of, respective races or projections 46. With this structure, the two inner membrane portions 70 are arranged with respect to one another in a manner which generally matches the right angle formed by the corner of window frame 66 at frame gap 68. In addition, each inner membrane portion 70 is also arranged with respect to its respective race 46 and outer membrane portion 72 in a manner which allows it to extend along the lateral faces 74/78 of inside and outside frame members 62/64 (FIG. 8), thereby effectively spanning and sealing frame gap 68.

As in the case of our earlier invention, modified corner sealing membrane 80 can be constructed by the glazer or installer on site by overlapping and bonding a pair of modified flexible sealing membrane sections 34 arranged at a right angle with respect to one another (or other appropriate angle), after removing interfering portions of the overlapped sections first. Alternately and preferably, modified corner sealing membrane 80 can be premade in the factory and supplied separately, in groups of two or more, and/or together in kit form with one or more of the other components forming the modified barrier assembly of this invention. In either case (i.e., whether premade or custom made on site), modified corner sealing membrane 80 is able to seal the building gap in which window frame 66 is received as well as frame gap 68 formed by the window frame itself without the puckering and/or multiple overlap problem characteristic of conventional sealing systems.

Figure 10:
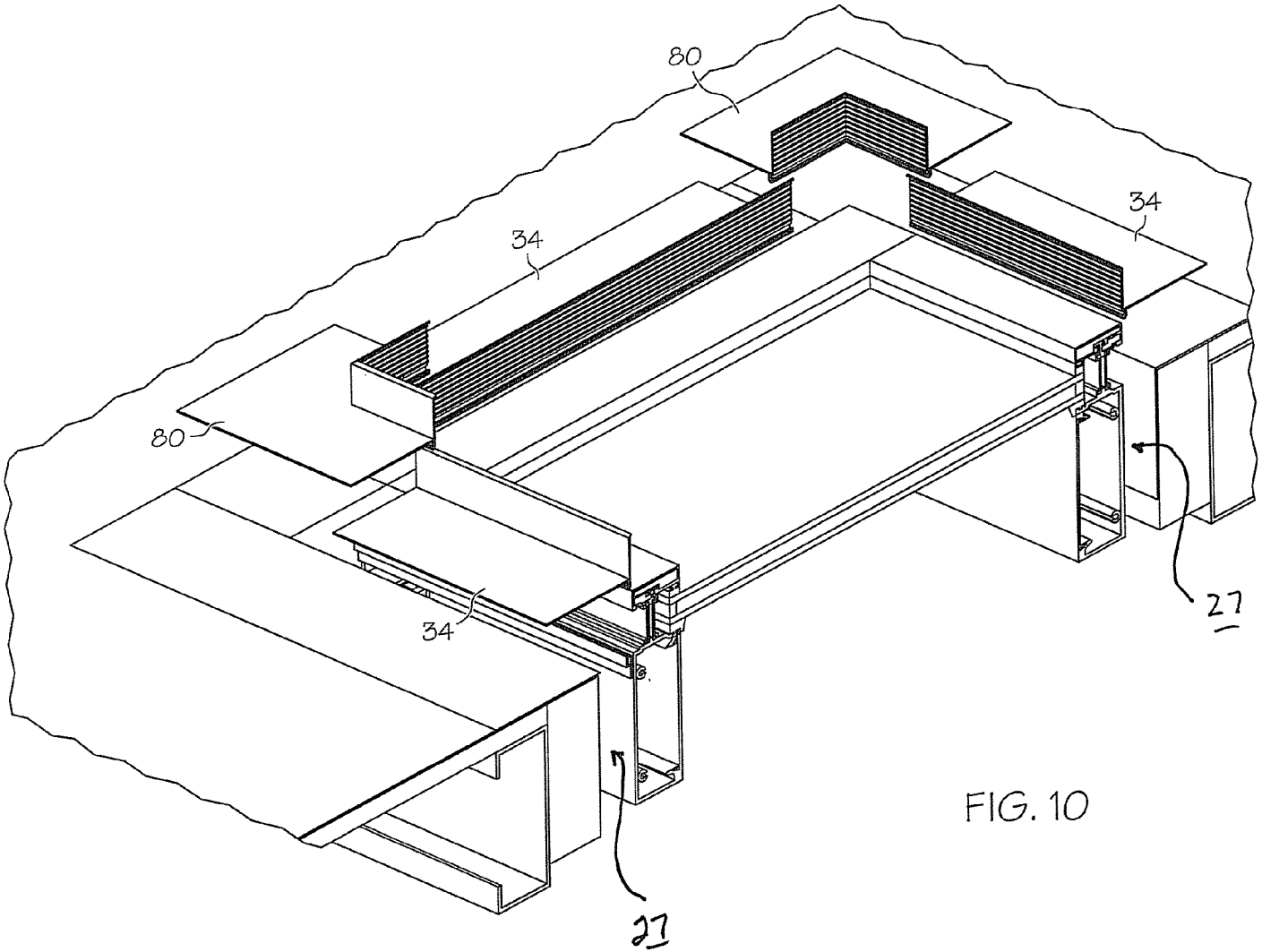
FIGS. 10 and 11 are perspective views illustrating how the modified corner membranes of FIG. 9 cooperate with modified flexible membrane sections illustrated in FIGS. 5 and 6 to form a modified moisture-proof sealing membrane in accordance with this invention.
Figure 11:
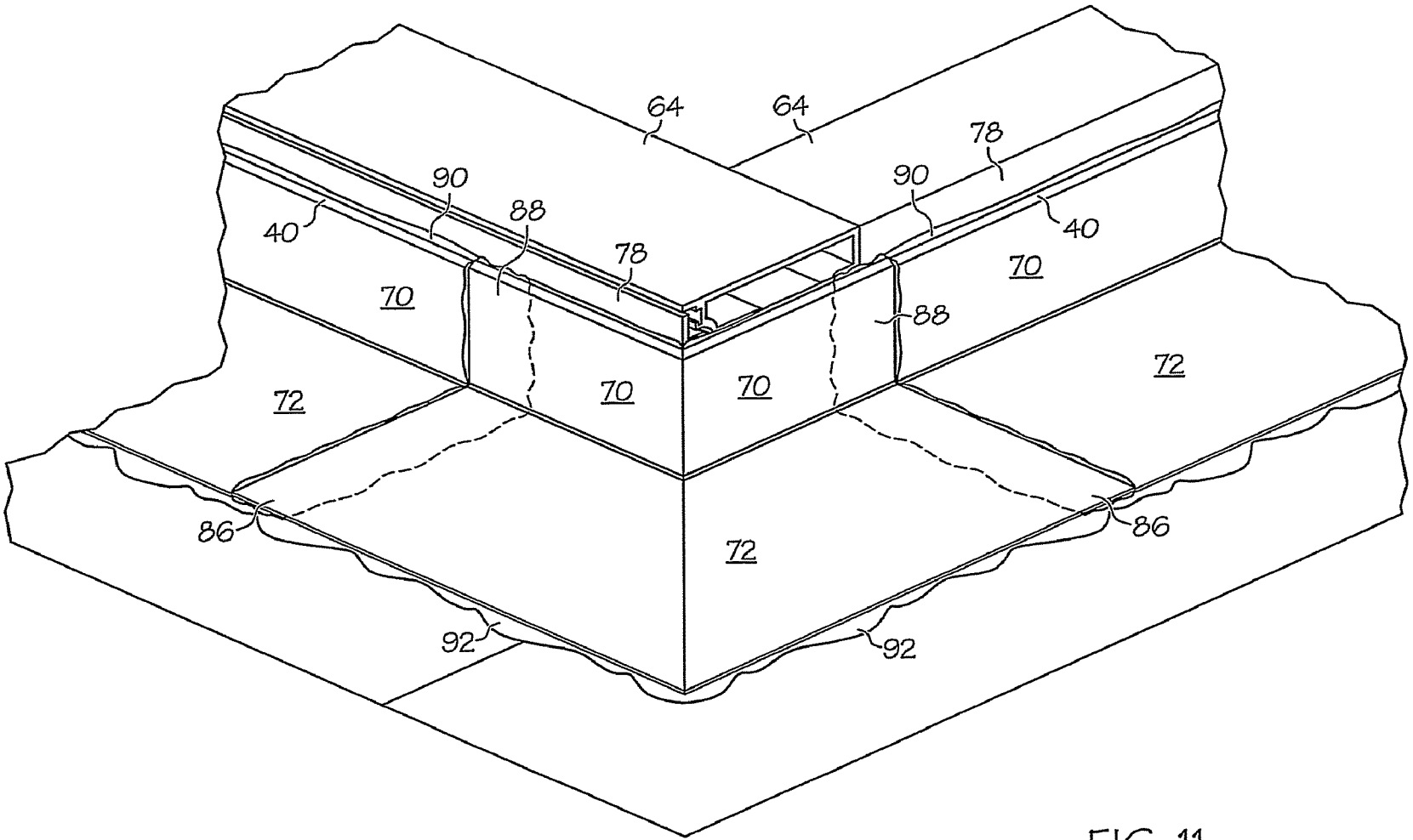

FIGS. 8, 10 and 11 illustrate how a particular embodiment of the modified barrier assembly of this invention can be fabricated and installed. As shown in FIG. 8, multiple adaptor sections 32 are carried by the lateral faces 74 of respective inside frame member sections 62 of an industrial window, preferably by means of a layer of a moisture-proof sealant or elastomeric tape (not shown) as well as by screws 99, in a manner such that they define adaptor 32 forming race 36 extending along at least a majority and preferably essentially all of the perimeter of the window frame. If desired, a quantity 84 of an optional sealant can also be deposited in race 36 of adaptor section 32 for achieving an even better air and moisture-proof seal, if desired.

As illustrated in FIG. 10, the inventive barrier assembly of this particular embodiment is composed of multiple modified flexible sealing membrane sections 34 and multiple modified corner sealing membranes 80, which together form a completed sealing membrane 34 extending completely around the entire perimeter of the window frame. To form an air and moister-proof seal with these membrane sections, as shown in FIG. 11, the inner membrane portions 70 of adjacent sealing membrane sections and corner membranes are preferably overlapped and sealed to one another with a moisture-proof sealant 88, while the outer membrane portions 72 of adjacent sealing membrane sections and corner membranes are also overlapped and sealed to one another with moisture-proof sealant 86. If desired, a bead of sealant 90 can be used to seal the junction between inside lateral edge 40 of flexible sealing membrane 34 and the lateral face 78 of outside frame member 64, either by applying this sealant bead over this junction and/or by applying this sealant bead between inside lateral edge 40 and lateral face 78 forming this junction. In addition, a layer of sealant 92 can also be applied to the underside of the outer flexible membrane portions 72 of the modified flexible membrane 34 and corner membranes 80 so that these outer flexible membrane portions 72 can be sealed to the structural members defining the building's rough opening. Normally, these outer membrane portions 72 will be sealed to the inside or outside surface of the building's exterior structural wall, which is usually (although not always) covered with an "air barrier" in the form of a flexible plastic sheet or sprayed-on layer of plastic. Alternately, outer membrane portions 72 can also be sealed to the lateral faces of the building's structural wall, i.e., the edges of the building's rough openings which generally face window frame 66, if desired.

From the foregoing, it can be seen that the modified barrier assembly of this invention, like the barrier assembly of our earlier invention, can be easily fabricated on-site by a glazer from stock pieces of adaptor 32 and modified flexible membrane 34 by cutting these stock pieces to length and then attaching the flexible membrane sections so formed to one another. Modified corner membranes 80 can also be used, if desired. Because the inside perimeter of the flexible sealing membrane formed in this way essentially corresponds to the outside perimeter of the window frame, including frame gap 68 formed between the inside and outside frame members forming this window frame, this flexible sealing membrane can be placed over the building gap between the window frame and the building's structural members in an essentially flat configuration, i.e., without the folding, substantial pucker or multiple overlapping of prior art approaches, while simultaneously completely sealing frame gap 68 as well. This promotes an effective air and moisture-proof seal in a very simple and straight forward manner.

Although only a few embodiments of the inventive barrier assembly have been described above, it should be appreciated that many modifications can be made without departing from the spirit and scope of the invention. For example, although the above disclosure indicates that adaptor 32 and sealing membrane are attached to the window frame so as to seal the inside or outside surface of the building's exterior structural wall 20, the sealing membrane could be attached so as to seal the building's fascia at least when made from a moisture-proof material such as masonry, metal or the like. Similarly, although the above disclosure shows the inside lateral edges of corner membrane section forming a right angle with respect to one another, these inside lateral edges can form any angle or shape corresponding to the window frame to be sealed. In addition, although the above disclosure shows elongated adaptor 32 being mounted on the lateral face 74 of inside frame member 62 at or near the forwardmost edge 76 of this surface, adaptor 32 can be located elsewhere on lateral face 74. Of course, the width of inner membrane portion 70 of flexible sealing membrane 34, i.e., distance "d," should be great enough so that inside lateral edge 40 extends to and is in sealing engagement with lateral face 78 of outer frame member 64. Still further, although the above description shows that the two darts or projections 46 in corner membrane 80 are arranged at right angles with respect to one another, these darts can be arranged at any other appropriate angle with respect to one another, both acute and obtuse. All such modifications are intended to be included within the scope of the present invention, which is to be limited only by the following claims:

The invention claimed is:

1. A barrier assembly for sealing a building gap formed between a window frame and a rough opening of a building in which the window is received, the rough opening being defined by building framing members, the window frame being formed by respective pairs of inside and outside frame members which sandwich a pair of spaced apart glass panes forming the window therebetween, the respective pairs of inside and outside frame members together also defining a frame gap therebetween, the barrier assembly comprising:

an adaptor carried by a first window frame member, the adaptor defining a channel along at least a majority of the perimeter of the window frame, and a flexible sealing membrane providing an air and moisture barrier between the window frame and the building framing members, the flexible sealing membrane being formed from multiple membrane sections, at least one of the membrane sections being formed from an essentially transparent silicone rubber, the at least one membrane section defining a flexible sheet and a projection integral with the flexible sheet, the flexible sheet defining an inner membrane portion associated with the window frame and an outer membrane portion associated with the building framing members, the inner membrane portion being arranged at a generally right angle with respect to the outer membrane portion, the inner membrane portion and the outer membrane portion each being wide enough so that when the projection is received in the channel of the adaptor, the inner membrane portion spans the frame gap while the outer membrane portion spans the building gap, thereby providing an air and moisture-proof barrier between the window frame and the associated building framing member.

2. The barrier assembly of claim 1, wherein the adaptor is attached to the inside frame member.

3. The barrier assembly of claim 2, wherein the flexible sealing membrane is formed from multiple membrane sections formed by extruding or molding an essentially transparent silicone rubber into the form of a flexible sheet having a major surface with the projection of the membrane section being integral with and projecting from this major surface.

4. The barrier assembly of claim 3, wherein each membrane section in its longitudinal direction defines an inside lateral edge associated with the window frame and an outside lateral edge associated with the building framing member of the building, the projection of each membrane section extending along a substantial portion of the length of the inside lateral edge, the projection of each membrane section being spaced from the inside lateral edge by a distance sufficient so that the inner membrane portion can be sealed to the outside frame member, the projection of each membrane section being spaced from the outside lateral edge by a distance sufficient so that the outer membrane portion can be sealed to a building framing member.

5. The barrier assembly of claim 4, wherein the rough opening of the building is defined by a structural wall having an outside surface, the projection of each membrane section being spaced from the outside lateral edge of the membrane section by a distance sufficient so that the outer membrane portion can be sealed to the outside surface of the structural wall.

6. The barrier assembly of claim 2, wherein the window frame has corners, each corner being defined by first and second intersecting frame side sections, wherein each intersecting frame side carries an adaptor section, wherein the sealing membrane is formed from a separate corner membrane for each corner, and wherein each corner membrane has a first projection received in the adaptor carried by a first window frame side section and a second projection received in the adaptor carried by a second window frame side section.

7. The barrier assembly of claim 6, wherein each corner membrane is formed by molding an essentially transparent silicone rubber to form a flexible sheet having a major surface with each projection being integral with and projecting from this major surface.

8. The barrier assembly of claim 7, wherein each corner membrane is sealed to the window frame and associated building framing members of the building without over-folding, lap joints or substantial pucker.

9. The barrier assembly of claim 1, wherein the entire flexible sealing membrane is formed from an elastomer consisting essentially of transparent silicone rubber.

* * * * *